US006837310B2

(12) United States Patent
Martin

(10) Patent No.: US 6,837,310 B2
(45) Date of Patent: Jan. 4, 2005

(54) INTELLIGENT PERFORATING WELL SYSTEM AND METHOD

(75) Inventor: Andrew J. Martin, Barton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/308,478

(22) Filed: Dec. 3, 2002

(65) Prior Publication Data

US 2004/0104029 A1 Jun. 3, 2004

(51) Int. Cl.[7] ..... E21B 29/02
(52) U.S. Cl. ..... 166/297; 166/55.1; 166/250.1
(58) Field of Search ..... 166/297, 299, 166/55, 57, 55.1, 63, 250.1

(56) References Cited

U.S. PATENT DOCUMENTS

| | | | |
|---|---|---|---|
| 4,220,212 | A | 9/1980 | Lands |
| 5,050,675 | A | 9/1991 | Upchurch |
| 5,249,461 | A | 10/1993 | Ponder et al. |
| 5,279,366 | A | 1/1994 | Scholes |
| 5,413,045 | A | 5/1995 | Miszewski |
| 5,598,894 | A | 2/1997 | Burleson et al. |
| 5,890,539 | A | 4/1999 | Huber et al. |
| 6,281,489 | B1 | 8/2001 | Tubel et al. |
| 6,283,227 | B1 | 9/2001 | Lerche et al. |
| 6,385,031 | B1 | 5/2002 | Lerche et al. |
| 6,386,108 | B1 | 5/2002 | Brooks et al. |
| 2002/0088620 | A1 | 7/2002 | Lerche et al. |
| 2002/0148611 | A1 | 10/2002 | Williger et al. |

FOREIGN PATENT DOCUMENTS

| | | |
|---|---|---|
| GB | 2374887 A | 10/2002 |
| WO | WO 00/20820 | 4/2000 |

*Primary Examiner*—Frank Tsay
(74) *Attorney, Agent, or Firm*—Trop, Pruner & Hu, P.C.; Jamie A. Castano; Brigitte Jeffery Echols

(57) ABSTRACT

An instrumented perforating gun and associated methods. One aspect provides a recess for placement of instruments on the perforating gun. Another aspect provides methods for perforating and completing a well in a single trip. The present invention also provides an instrumented intergun housing. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

44 Claims, 7 Drawing Sheets

INTELLIGENT PERFORATING WELL SYSTEM AND METHOD

BACKGROUND OF THE INVENTION

1. Field of Invention

The present invention relates to the field of well monitoring. More specifically, the invention relates to equipment and methods for real time monitoring of wells during various processes.

2. Related Art

There is a continuing need to improve the efficiency of producing hydrocarbons and water from wells. One method to improve such efficiency is to provide monitoring of the well so that adjustments may be made to account for the measurements. Other reasons, such as safety, are also factors. Accordingly, there is a continuing need to provide such systems. Likewise, there is a continuing need to improve the placement of well treatments.

SUMMARY

In general, according to one embodiment, the present invention provides monitoring equipment and methods for use in connection with wells. Another aspect of the invention provides specialized equipment for use in a well.

Other features and embodiments will become apparent from the following description, the drawings, and the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention. However, it will be understood by those skilled in the art that the present invention may be practiced without these details and that numerous variations or modifications from the described embodiments may be possible.

In this description, the terms "up" and "down"; "upward" and downward"; "upstream" and "downstream"; and other like terms indicating relative positions above or below a given point or element are used in this description to more clearly described some embodiments of the invention. However, when applied to apparatus and methods for use in wells that are deviated or horizontal, such terms may refer to a left to right, right to left, or other relationship as appropriate.

Figure 1:
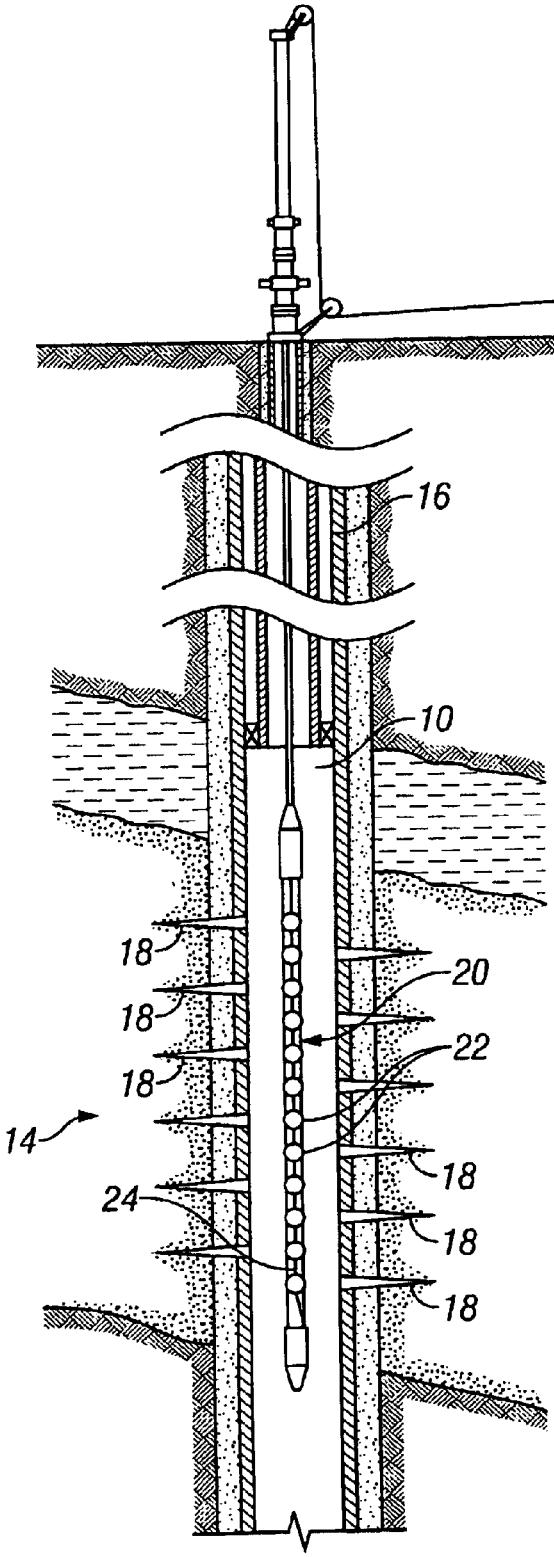
FIG. 1 illustrates a well having a perforating gun with a control line therein.

One aspect of the present invention is the use of a sensor, such as a fiber optic distributed temperature sensor, in a well to monitor an operation performed in the well, such as a perforating job as well as production from the well. Other aspects comprise the routing of control lines and sensor placement in a perforating gun and associated completions. Yet another aspect of the present invention provides a perforating gun 20 which is instrumented (e.g., with a fiber optic line 24 or an intelligent completions device 26). Referring to the attached drawings, FIG. 1 illustrates a wellbore 10 that has penetrated a subterranean zone that includes a productive formation 14. The wellbore 10 has a casing 16 that has been cemented in place. The casing 16 has a plurality of perforations 18 formed therein that allow fluid communication between the wellbore 10 and the productive formation 14. Firing a perforating gun 20 having shaped charges 22 at the desired position in the well forms the perforations. The perforating gun 20 embodiment of FIG. 1 is a wireline-conveyed perforating gun and is instrumented with a control line 24 extending the length of the gun 20. FIG. 1 also illustrates one embodiment in a cased hole although the present invention may be utilized in both cased wells and open hole completions.

Although shown with the control line 24 outside the perforating gun 20, other arrangements are possible as disclosed herein. Note that other embodiments discussed herein will also comprise intelligent completions devices 26 on the perforating gun 20 or the associated completion.

Examples of control lines 24 are electrical, hydraulic, fiber optic and combinations of thereof. Note that the communication provided by the control lines 24 may be with downhole controllers rather than with the surface and the telemetry may include wireless devices and other telemetry devices such as inductive couplers and acoustic devices. In addition, the control line itself may comprise an intelligent completions device as in the example of a fiber optic line that provides functionality, such as temperature measurement (as in a distributed temperature system), pressure measurement, sand detection, seismic measurement, and the like. Additionally, the fiber optic line may be used to detect detonation of the guns.

In the case of a fiber optic control line, the control line 24 may be formed by any conventional method. In one embodiment of the present invention, a fiber optic control line 24 is formed by wrapping a flat plate around a fiber optic line in a similar manner as that shown in U.S. Pat. No. 5,122,209. In another embodiment, the fiber optic line is installed in the tube by pumping the fiber optic line into a tube (e.g., a hydraulic line) installed in the well. This technique is similar to that shown in U.S. reissue Pat. No. 37,283. Essentially, the fiber optic line 14 is dragged along the conduit 52 by the injection of a fluid at the surface, such as injection of fluid (gas or liquid) by pump 46. The fluid and induced injection pressure work to drag the fiber optic line 14 along the conduit 52.

Examples of intelligent completions devices 26 that may be used in the connection with the present invention are gauges, sensors, valves, sampling devices, a device used in intelligent or smart well completion, temperature sensors, pressure sensors, flow-control devices, detonation detectors, flow rate measurement devices, oil/water/gas ratio measurement devices, scale detectors, actuators, locks, release mechanisms, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, locators, devices to determine the orientation, and other downhole devices. In addition, the control line itself may comprise an intelligent completions device as mentioned above. In one example, the fiber optic line provides a distributed temperature and/or pressure functionality so that the temperature and/or pressure along the length of the fiber optic line may be determined.

In an embodiment of FIG. 1 in which the control line 24 is a fiber optic line, the fiber optic line 24 is connected to a receiver 12 that may be located in the vehicle 13. Receiver 12 receives the optical signals through the fiber optic line 14. Receiver 12, which would typically include a microprocessor and an opto-electronic unit, converts the optical signals back to electrical signals and then delivers the data (the electrical signals) to the user. Delivery to the user can be in the form of graphical display on a computer screen or a print out or the raw data. In another embodiment, receiver 12 is a computer unit, such as laptop computer, that plugs into the fiber optic line 24. In each embodiment, the receiver 12 processes the optical signals or data to provide the chosen data output to the operator. The processing can include data filtering and analysis to facilitate viewing of the data.

Figure 2:
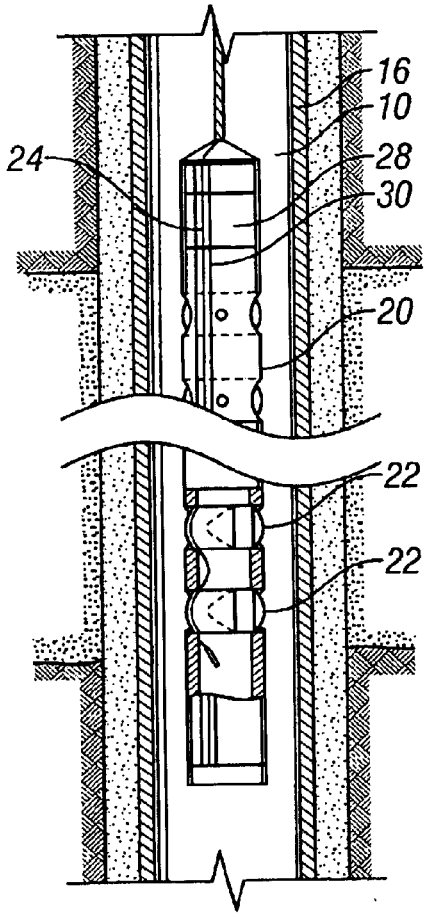
FIG. 2 illustrates a perforating gun in a well having a control line positioned in a passageway of the gun housing.

FIG. 2 shows a wireline-conveyed perforating gun 20 having a hollow-carrier gun housing 28 and a plurality of shaped charges 22. The housing 28 has a passageway 30 (control line passageway) formed in the wall thereof with a control line 24 extending through the passageway 30. The passageway 30 provides protection for the control line 24 and reduces the overall size of the perforating gun 20 when compared to a perforating gun in which the control line 24 is provided on an outer surface of the housing 28.

Figure 3:
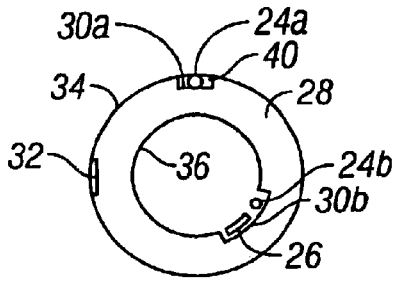
FIG. 3 illustrates a cross sectional view of a perforating gun housing of the present invention showing numerous alternative designs.

FIG. 3 is a cross sectional view of the housing 28 showing alternative positions for the passageway 30, the control line 24, and the intelligent completions device 26. The housing 28 has a scallop 32 therein. A scallop 32, or recess, is a thinned portion of the gun housing 28. A shaped charge 22 within the housing 28 is aligned with the scallop 32 to minimize the energy loss required to penetrate the housing 28. The passageway 30, the control line 24 and the intelligent completions device 26 are spaced from the scallop 32 to prevent damage to the instrumentation (i.e., the control line 24 and intelligent completions device 26) when the shaped charges 22 are fired. However, in some applications it may be desirable to fire through a control line 24 or a component of an intelligent completions component 26 to, for example, detect detonation or for other purposes.

In one alterative embodiment shown in FIG. 3, a control line 24*a* is provided in a passageway 30*a* formed in the outer surface 34 of the housing 28. In another alternative embodiment shown in FIG. 3, a passageway 30*b* is formed in an inner surface 36 of the housing 28. An intelligent completions device 26 and a control line 24*b* are positioned in the passageway 30*b*.

Figure 4:
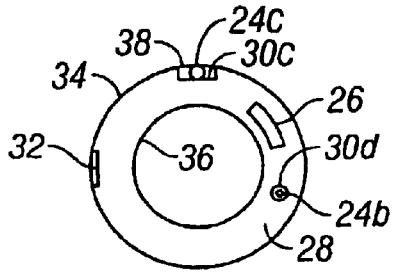
FIG. 4 is a cross sectional view of a perforating gun housing of the present invention showing numerous alternative designs.

FIG. 4 illustrates one alternative embodiment in which a passageway 30*c* formed in the housing outer surface 34 has a control line 24*c* therein. A cover 38 is provided over at least a portion of the length of the passageway 30*c* to maintain the control line 24*c* in the passageway 30*c*. The cover 38 may be removeably or fixedly attached to the housing 28 such as by welding, screws, rivets, by snapping into mating grooves in the housing 28, or by similar means. Alternatively, the perforating gun 20 may comprise one or more cable protectors, restraining elements, clips, adhesive, epoxy, cement, or other materials to keep the control line 24 in the passageway 30.

In one embodiment, shown in FIG. 3, a material filler 40 is placed in the passageway 30*a* to mold the control line 24*a* in place. As an example, the material filler 40 may be an epoxy, a gel that sets up, or other similar material. In one embodiment, the control line 24*a* is a fiber optic line that is molded to, or bonded to, the perforating gun 20. In this way, the stress and/or strain applied to the perforating gun 20 may be detected and measured by the fiber optic line 24*a*.

Another embodiment shown in FIG. 4 provides an internal passageway 30*d* within the wall of the housing 28. A control line 24*d* extends through the internal passageway 30*d*.

FIG. 4 also shows an embodiment for positioning of an intelligent completions device 26 (e.g., a sensor). As in the embodiment shown, the intelligent completions device 26 may be placed within the wall of the housing 28.

Figure 5:
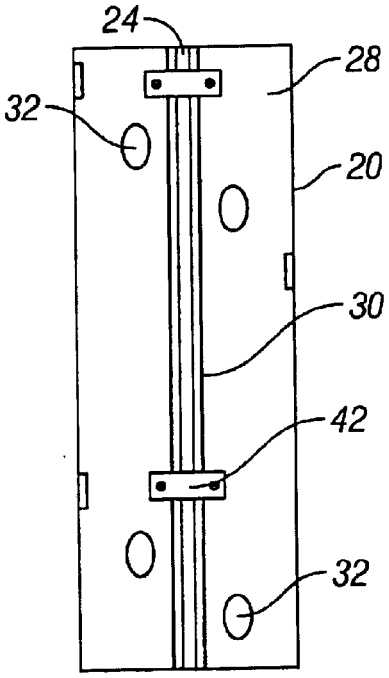
FIG. 5 is a side elevational view of a perforating gun housing of the present invention.

FIG. 5 shows a perforating gun 20 having a housing 28 with a passageway 30 (e.g., a recess, or indentation) formed in the outer surface 34 thereof. Brackets 42, or clips, secure the control line 24 within the passageway 30. The passageway 30 and control line 24 are offset from the gun scallops 32.

Figure 6:
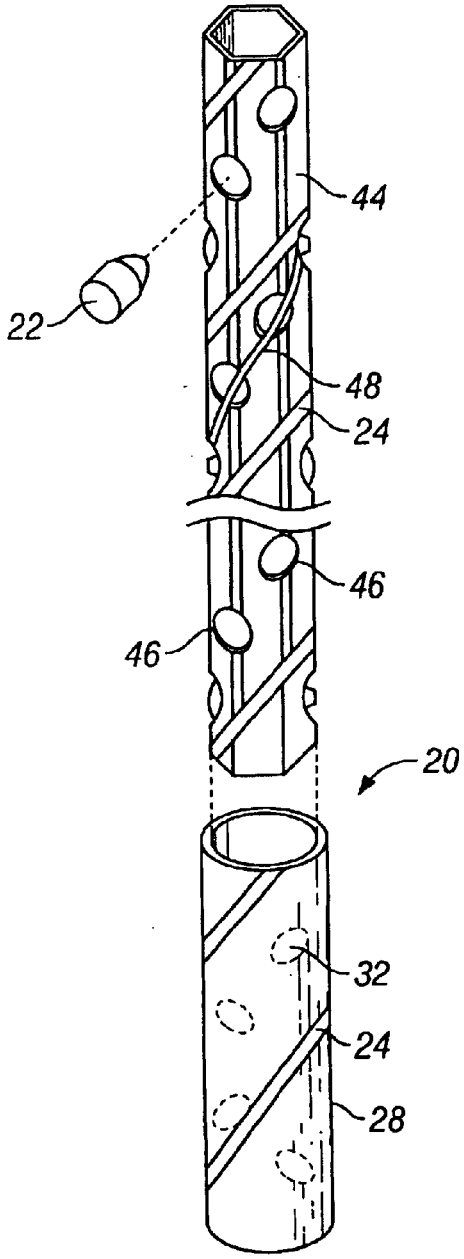
FIG. 6 shows an alternative embodiment of the present invention.

FIG. 6 illustrates a perforating gun 20 that comprises a housing 28 and a loading tube 44. The loading tube 44 has a plurality of openings 46 for holding shaped charges 22. A detonating cord 48 is routed along the back of the shaped charges to fire the shaped charges 22. The loading tube is placed in the housing 28 with the shaped charges 22 aligned with the housing scallops 32. One embodiment of the invention illustrated in FIG. 6 has a control line 24 extending the length of the loading tube 44. As discussed above with respect to the housing 28, the control line 24 may extend through a passageway 30 provided on the loading tube 44 (e.g., the interior surface, the exterior surface, or internal to the wall). Another embodiment of FIG. 6 shows a control line 24 provided on the housing 28 of the perforating gun 20.

Note that, in each of the embodiments discussed herein, the control line 24 may extend the full length of the perforating gun 20 or a portion thereof. Additionally, the control line 24 may extend linearly along the perforating gun 20 or follow an arcuate, or nonlinear, path. FIG. 6 illustrates a perforating gun 20 having a control line 24 that is routed in a helical path along the perforating gun 20 (both the loading tube embodiment and the housing embodiment). In one embodiment, the control line 24 comprises a fiber optic line that is helically wound about the perforating gun 20 (internal or external to the perforating gun 20). In this embodiment, a fiber optic line 24 that comprises a distributed temperature system, or that provides other functionality (e.g., distributed pressure measurement), has an increased resolution. Other paths about the perforating gun 20 that increase the length of the fiber optic line 24 per longitudinal unit of length of perforating gun 20 will also serve to increase the resolution of the functionality provided by the fiber optic line 24.

Figure 7:
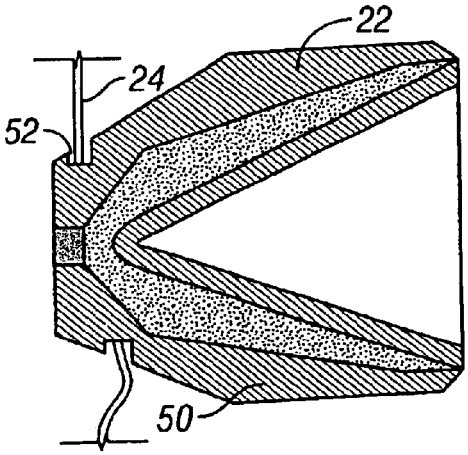
FIG. 7 illustrates another embodiment of the present invention.

FIG. 7 discloses another embodiment of the present invention in which a control line 24 is provided adjacent a shaped charge 22. In the embodiment shown, the shaped charge 22 has a case passageway 52 provided in the shaped charge case 50. The control line 24 extends through the case passageway 52. In one embodiment, the control line 24 is a fiber optic line used for shot detection. When the shot fires, the fiber optic line is broken at that point. Light reflected through the fiber optic line indicates the end of the fiber optic line and point at which the line was broken.

Figure 8:
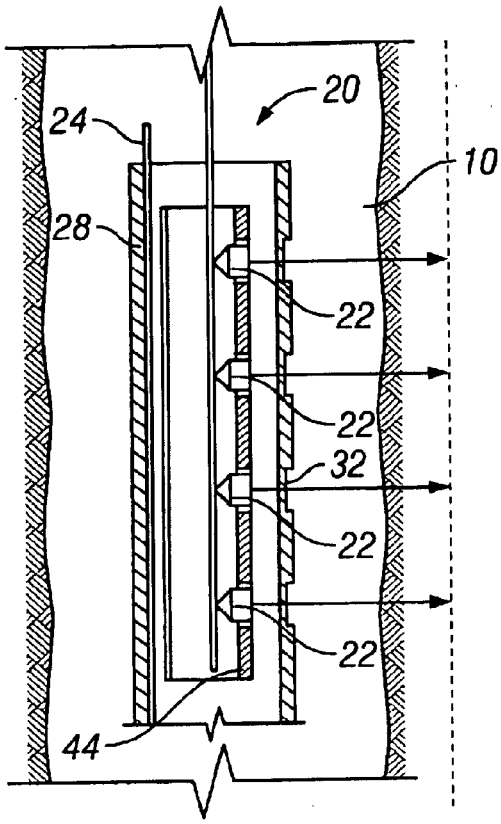
FIG. 8 is a partial cross sectional view of an alternative embodiment of the present invention.

FIG. 8 shows a wireline-conveyed perforating gun 20 having a control line 24 in the housing 28 and extending the length thereof.

Figure 9:
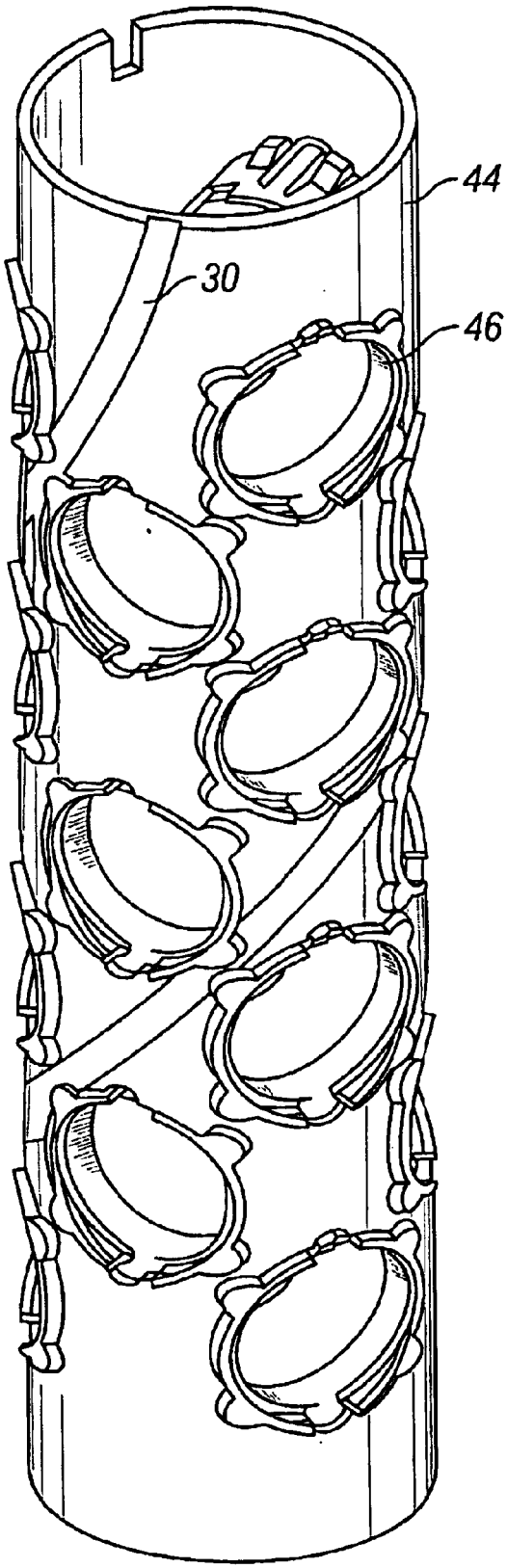

FIG. 9 shows an alternative embodiment in which the passageway 30 is routed in an arcuate path (e.g., helical) along the loading tube of a high shot density perforating gun 20.

Figure 10:
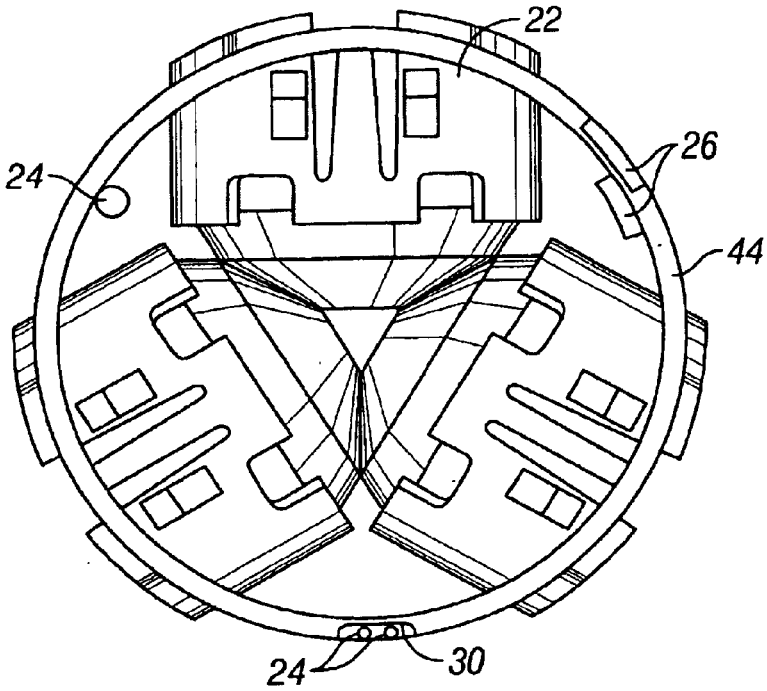
FIGS. 9 through 16 illustrate various other alternative embodiments of the present invention.

FIG. 10 is a cross sectional view of a loading tube 44 showing additional alternative embodiments for instrumenting a perforating gun 20. One embodiment shows a passageway 30 extending along the loading tube 44. A pair of control lines 24 are routed through the passageway 30. Another embodiment illustrated in FIG. 10 provides an intelligent completions device 26 mounted in the wall of the loading tube 44, such as in a recess provided in the wall, or inside the loading tube 44. Yet another embodiment shown in FIG. 10 provides a control line 24 inside the loading tube.

Although the aforementioned perforating guns 20 have been described as wireline-conveyed, tubing could also convey the guns 20.

Figure 11:
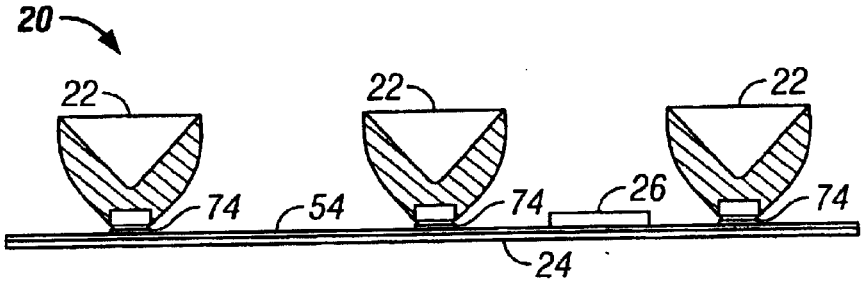
Figure 12:
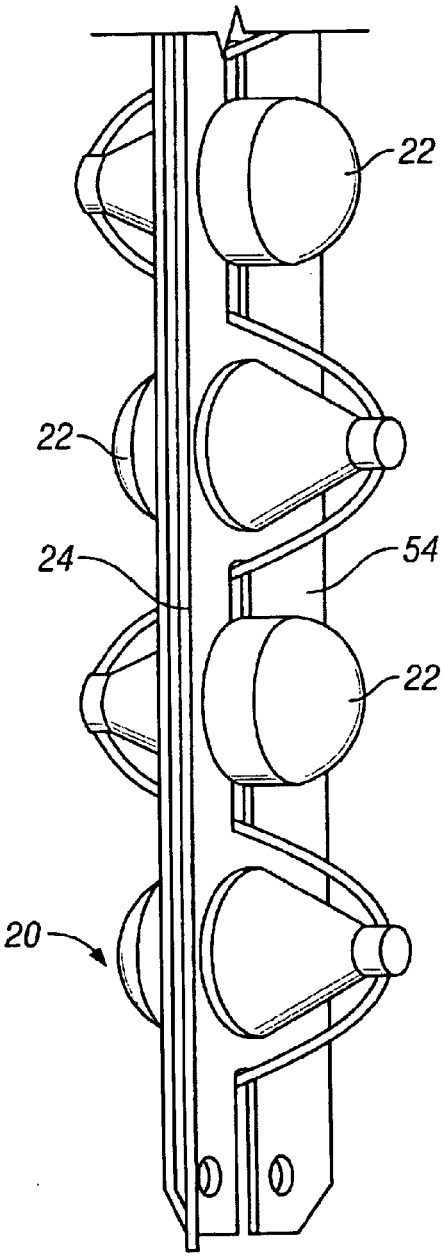

FIGS. 11 through 16 illustrate embodiments of the present invention in which the perforating gun 20 comprises a plurality of shaped charges 22 mounted on a carrier 54. FIG. 11 shows a semi-expendable perforating gun 20 having a linear carrier 54. A control line 24 is mounted to the carrier 54. Similarly, FIG. 12 shows a semi-expendable carrier 54 having a plurality of capsule shaped charges 22 mounted thereon and a control line 24 mounted to the carrier 54. Expendable guns may also be used with the present invention.

As used herein, the housing 28, loading tube 44, and carrier 54 are generically referred to as a "carrier component" of the perforating gun 20.

Figure 13:
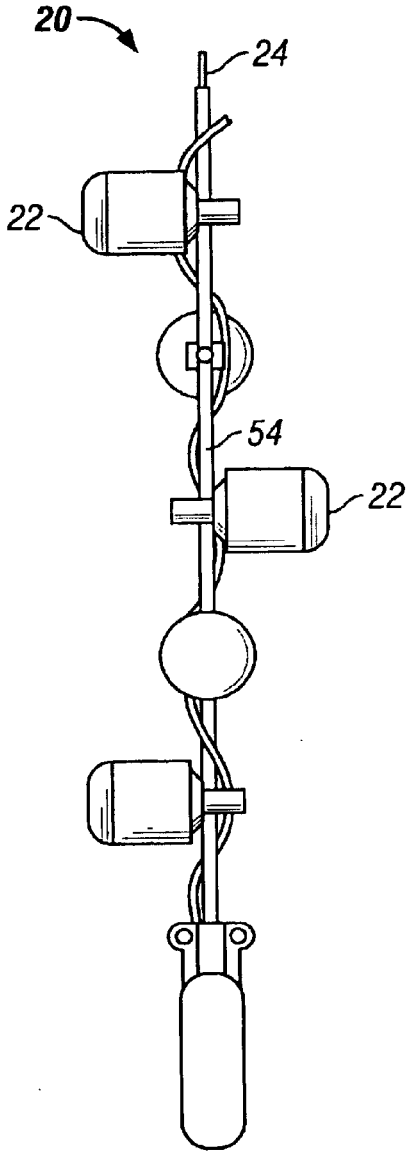

In the perforating gun 20 of FIG. 13, the carrier 54 is a hollow tube. A control line 24 extends through the carrier 54, hollow tube.

Figure 14:
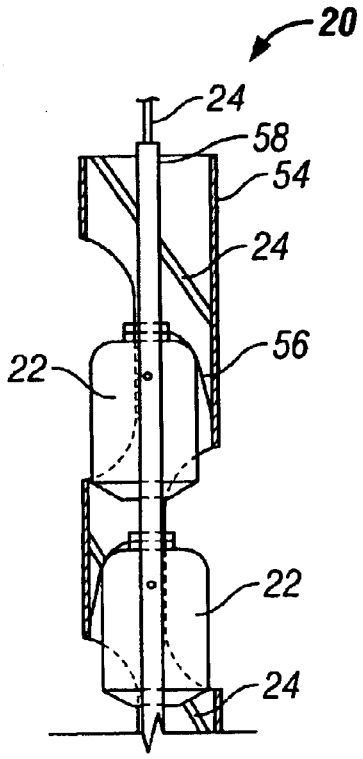
Figure 15:
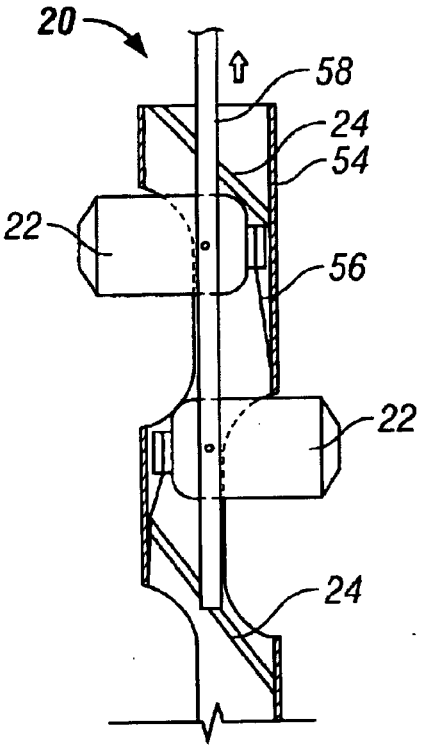

FIGS. 14 and 15 show an alternative embodiment of the present invention used in conjunction with a pivot perforating gun 20. The pivot gun 20 has a carrier 54 and a pull rod 58. The shaped charges 22 are mounted to the pull rod 58 in a first position in which the axis of the shaped charges 22 generally pointed along the axis of the perforating gun 20. Once downhole, the pull rod 58 is caused to move relative to the carrier 54. A retainer 56 connecting each of the shaped charges to the carrier cause the shaped charges 22 to rotate to a second firing position. The pivot gun 20 may use a variety of other schemes to achieve the pivoting of the shape charges 22.

FIG. 14 illustrates alternative embodiments of the present invention. In one embodiment, the pull rod 58 is a hollow tube having a control line 24 extending therein. In another embodiment, the carrier 54 has a control line 24 mounted therein (see also FIG. 15).

Figure 16:
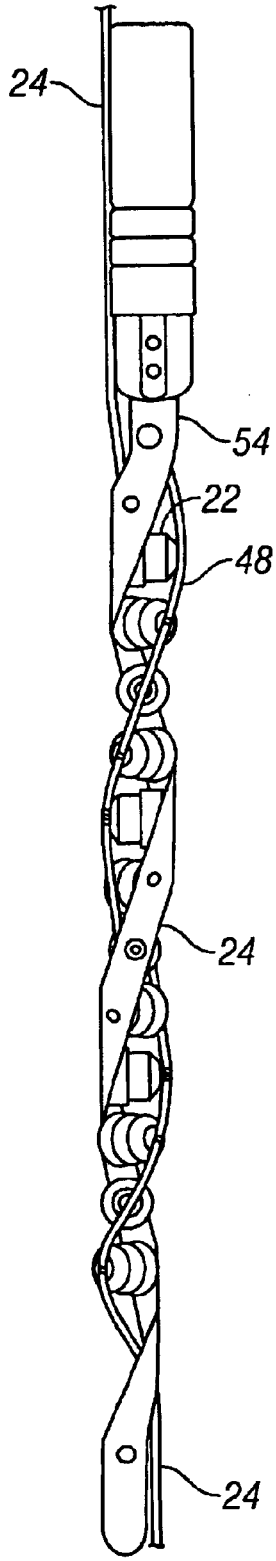

FIG. 16 shows another embodiment in which the perforating gun 20 comprises a spiral strip carrier 54 in which the carrier 54 is formed into a helical shape. A control line 24 extends along the carrier strip 54.

It should be noted from the above that the shaped charges may be oriented in a variety of phasing patterns as illustrated in the figures.

Figure 17:
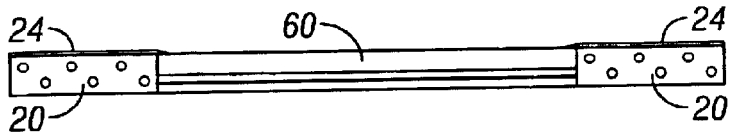
FIG. 17 shows an intergun housing of the present invention.

FIG. 17 shows another embodiment of the present invention in which adjacent perforating guns are interconnected by an intergun housing 60. The intergun housing 60 may contain one or more intelligent completions devices 26 that may be used, for example, to measure reservoir parameters, production characteristics, gun orientation, and gun performance metrics. Additionally, the intelligent completions device 26 in the intergun housing 60 may comprise safety devices that prevent detonation until certain conditions are satisfied (e.g., certain downhole parameters, like pressure, temperature, location, or orientation). Further, the intergun housing may comprise a swivel, a motor, or other device that will facilitate orientation of the perforating gun 20. Also, the intergun housing 60 may contain other devices that inflate to isolate sections of the wellbore, to shut off zones, or devices that choke back production from sections of the well.

Figure 18:
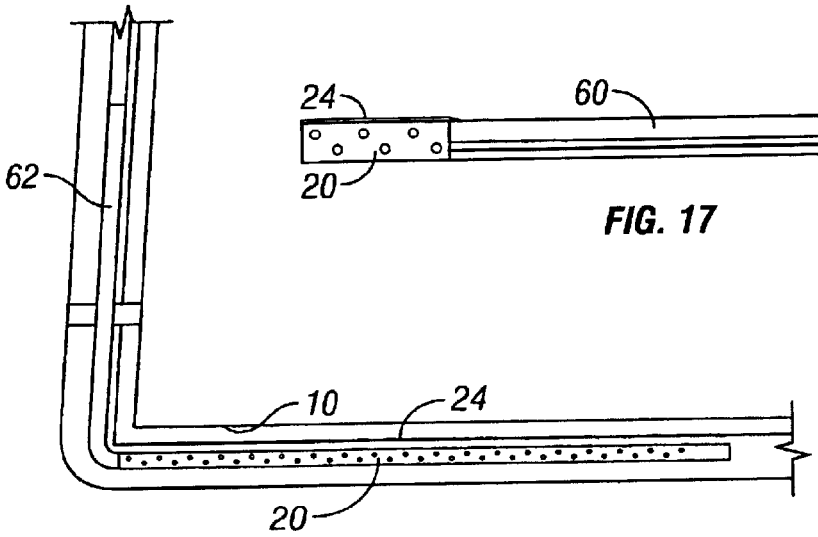
FIG. 18 illustrates an embodiment of the present invention in which an instrumented perforating gun is provided with a completion.

FIG. 18 illustrates an alternative embodiment of the present invention in which the perforating guns 20 are run as part of a permanent completion 62. A completion 62 may comprise a large variety of components and jewelry such as packers, safety valves, sand screens, flow control valves, pumps, intelligent completions devices, and the like. In some circumstances, it is desirable to run the perforating gun 20 with the completion 62 to reduce the number of trips into the well and for other reasons. FIG. 18 shows a permanent completion 62 having a perforating gun 20 and a control line extending along the completion 62 and the perforating gun 20.

Figure 19:
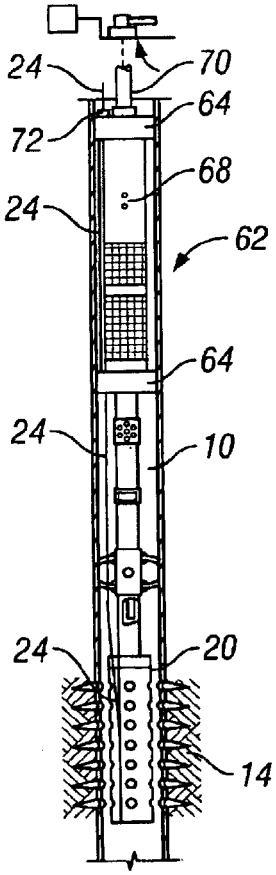
FIG. 19 illustrates an embodiment of the present invention in which the well may be perforated and gravel packed in a single trip into the well.

FIG. 19 shows another embodiment of the present invention in which the well is perforated and gravel packed in a single trip into the well. The completion 62 has a perforating gun 20 connected thereto and comprises packers 64, a sand screen 66, and a crossover port 68. The assembly of the completion 62 and the perforating gun is run into the well on a service string 70. A control line 24 extends along the completion 62 and the perforating gun 20. Once the perforating gun 20 is aligned with the formation 14, the perforating gun 20 is fired. Generally, the perforating gun 20 is dropped into the rathole. The completion 62 is then moved into place and the packers 64 are set to isolate the formation 14. Next, the annulus between the sand screen 66 and the wellbore wall is gravel packed and the service string 70 is removed from the well and replaced with a production tubing. In alternative systems, the gravel pack operation is performed using a through-tubing service tool so that the run-in string may also serve as the production string.

However, if a through-tubing gravel pack operation is not used and the service string 70 is replaced with a production tubing, the control line 24 extending above the packer 64 may need to be replaced. Accordingly, in one embodiment, the present invention uses a connector 72 at or near the upper packer 64 that allows the control line 64 to separate so that the upper portion of the control line 24 (the portion above the packer 64) may be removed from the wellbore 10. When the production tubing is placed in the well 10, a control line attached to the production tubing has a connector 72 that completes the connection downhole of the control line below the upper packer 64 that was previously left in the well 10 with the control line 24 attached to the production tubing.

Figure 20:
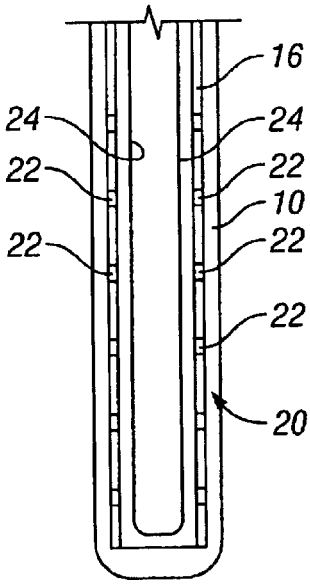
FIG. 20 shows an embodiment of the present invention in which the perforating charges are provided in the casing.

In the embodiment of FIG. 20, the perforating gun 20 is a casing-conveyed perforating gun 20. In this embodiment, the casing 16 has one or more shaped charges 22 mounted thereto. The shaped charges 22 may be mounted in the wall of the casing 16, inside the casing 16, or attached to the outside of the casing 16. A control line 24 extends along the perforating gun 20 (the portion of the casing having the shaped charges 22 therein). In the disclosed embodiment, the control line 24 has a 'U' configuration and extends from the surface into the well and returns to the surface. Such a 'U' configuration is particularly useful when the control line 24 is a fiber optic line that is blown into the well as previously described. In such a case, the control line may provide redundancy.

In some embodiments, the perforating gun 20 uses alternative forms of initiators 74 (see FIG. 11) for activating the shaped charges 22. As an example, the initiator 74 may be an exploding foil initiator (EFI) which is electrically activated. As used here, "exploding foil initiator" may be of various types, such as exploding foil "flying plate" initiators and exploding foil "bubble activated" initiators. In addition, in further embodiments, exploding bridgewire initiators may also be employed. Such initiators, including EFIs and EBW initiators, may be referred to generally as high-energy bridge-type initiators in which a relatively high current is dumped through a wire or a narrowed section of a foil (both referred to as a bridge) to cause the bridge to vaporize or "explode." The vaporization or explosion creates energy to cause a flying plate (for the flying plate EFI), a bubble (for the bubble activated EFI), or a shock wave (for the EBW initiator) to detonate an explosive. Some electrical initiators are described in described in commonly assigned copending U.S. Pat. No. 6,385,031, issued May 7, 2002, entitled "Switches for Use in Tools" and U.S. Pat. No. 6,386,108, issued May 14, 2002, entitled "Initiation of Explosive Devices," which are hereby incorporated by reference.

When using an EFI or other electrically activated initiator, it is possible to selectively fire a sequence of perforating strings or even a series of shaped charges. As an example, if a plurality of control devices including a microcontroller and detonator assembly are coupled on a wireline, switches within the perforating gun may be controlled to selectively activate control devices by addressing commands to the control devices in sequence. This allows firing of a sequence of perforating strings or shaped charges in a desired order. Selective activation of a sequence of tool strings is described in commonly assigned copending U.S. Pat. No. 6,283,227, issued Sep. 4, 2001, entitled "Downhole Activation System That Assigns and Retrieves Identifiers" and U.S. patent application Ser. No. 09/404,522, filed Sep. 23, 1999 and published as WO 00/20820 on Apr. 13, 2000, entitled "Detonators for Use with Explosive Devices," which are hereby incorporated by reference.

Accordingly, a perforating gun 20 having electrically activated initiators 74 may be instrumented in the manner previously described. In such a system, the instrumentation (e.g., the fiber optic line 24 or the intelligent completions device 26) may provide data during the perforation job. For example, the instrumentation may provide information relating to shot confirmation, pressure, temperature, or flow, among other information, between individual gun 20 or shaped charge 22 detonations. Therefore, in one example, a perforating gun 20 having a plurality of shaped charges 22 and electrically activated initiators is run into a well 10. The shaped charges 22 are fired in a particular sequence while providing the option of moving the perforating gun 20 between shots, skipping defective charges 22, as well as other features. The instrumentation 24, 26 provides feedback regarding shot confirmation. In another example, the instrumentation 24, 26 measures the temperature and pressure in the well following each shot.

In another embodiment of the present invention, the instrumentation 24, 26 of the perforating gun 20 is used to determine the placement of a fracturing treatment, chemical treatment, cement, or other well treatment by measuring the temperature or other well characteristic during the injection of the fluid into the well. The temperature may be measured during a strip rate test in like manner. In each case remedial action may be taken if the desired results are not achieved (e.g., injecting additional material into the well, performing an additional operation). It should be noted that in one embodiment, a surface pump communicates with a source of material to be placed in the well. The pump pumps the material from the source into the well. Further, the instrumentation 24, 26 in the well may be connected to a controller that receives the data from the intelligent completions device and provides an indication of the placement position using that data. In one example, the indication may be a display of the temperature at various positions in the well. In another example, the remedial action comprises firing a perforating gun 20. In this example, the remedial action may comprise perforating a particular zone again, perforating a longer interval of the wellbore, perforating another zone, or the like.

The instrumented perforating gun 20 of the present invention should not be confused with prior perforating guns which have sensors placed above or below the perforating gun. Accordingly, in the present invention the term "instrumented" and the like shall mean that the instrumentation is provided on the perforating gun 20 itself, such as attached to a housing 28, loading tube 44, or carrier 54 of the gun 20, positioned below the uppermost shaped charge 22 of the perforating gun 20 and above the lowermost shaped charge 22, between shaped charges 22, or in the substantially the same cross sectional portion of the well 10 as the shaped charges 22. Thus, the instrument 24, 26 is provided on the same shaped charge region of the perforating gun 20 as the shaped charges 22.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

I claim:

1. A perforating gun, comprising:

a plurality of shaped charges in a shaped charge region of the perforating gun;

an instrument in the shaped charge region, the instrument comprising at least one of a hydraulic line and fiber optic line.

2. The perforating gun of claim 1, further comprising:

a carrier component;

the plurality of shaped charges are mounted to the carrier component;

a control line passageway in the carrier component;

the control line passageway follows a nonlinear path along the perforating gun.

3. The perforating gun of claim 2, wherein the control line passageway follows a helical path along the perforating gun.

4. A perforating gun, comprising:

a plurality of shaped charges in a shaped charge region of the perforating gun;

an instrument in the shaped charge region;

a carrier component;

the plurality of shaped charges are mounted to the carrier component;

a recess in the carrier component;

the instrument is positioned in the recess.

5. The perforating gun of claim 4, wherein the recess comprises a control line passageway and the instrument comprises a fiber optic line.

6. The perforating gun of claim 4, wherein the carrier component comprises one or more of a housing, a loading tube, and a carrier.

7. The perforating gun of claim 4, wherein the carrier component comprises a housing and the plurality of shaped charges are mounted to the housing via a loading tube.

8. A perforating gun, comprising:

a plurality of shaped charges in a shaped charge region of the perforating gun;

an instrument in the shaped charge region, wherein the instrument comprising an intelligent completions device.

9. A perforating gun, comprising:

a plurality of shaped charges in a shaped charge region of the perforating gun;

an instrument in the shaped charge region;

wherein instrument is selected from gauges, sensors, valves, sampling devices, a device used in intelligent or smart well completion, temperature sensors, pressure sensors, flow-control devices, detonation detectors, flow rate measurement devices, oil/water/gas ratio measurement devices, scale detectors, actuators, locks, release mechanisms, equipment sensors (e.g., vibration sensors), sand detection sensors, water detection sensors, data recorders, viscosity sensors, density sensors, bubble point sensors, pH meters, multiphase flow meters, acoustic sand detectors, solid detectors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, locators, devices to determine the orientation, and fiber optic lines.

10. A perforating gun, comprising:

a carrier component;

a control line passageway formed in the carrier component; and a fiber optic line in the control line passageway.

11. The perforating gun of claim 10, wherein the carrier component is a housing.

12. The perforating gun of claim 10, wherein the carrier component is a loading tube.

13. The perforating gun of claim 10, wherein the carrier component is a carrier.

14. The perforating gun of claim 10, wherein the carrier component has a central bore therethrough and the control line passageway is offset from the central bore.

15. The perforating gun of claim 10, wherein the carrier component comprises a wall having the control line passageway formed therein.

16. The perforating gun of claim 15, wherein the control line passageway comprises a bore in the wall of the carrier component.

17. The perforating gun of claim 10, wherein the control line passageway is provided in an outer surface of the carrier component.

18. The perforating gun of claim 10, wherein the control line passageway is provided in an inner surface of the carrier component.

19. The perforating gun of claim 10, wherein the control line passageway follows a linear path along the carrier component.

20. The perforating gun of claim 10, wherein the control line passageway follows a nonlinear path along the carrier component.

21. The perforating gun of claim 10, wherein the control line passageway follows a arcuate path along the carrier component.

22. The perforating gun of claim 10, wherein the control line passageway follows a helical path along the carrier component.

23. The perforating gun of claim 10, further comprising a control line in the control line passageway.

24. A perforating gun, comprising:

a carrier component;

a recess provided in the carrier component; and one or more of an intelligent completions device and a control line in the recess.

25. The perforating gun of claim 24, wherein the recess has an intelligent completions device therein.

26. The perforating gun of claim 24, wherein the recess has a fiber optic line therein.

27. A method for perforating a well, comprising:

running an instrumented perforating gun into the well;

activating the perforating gun; and monitoring a characteristic in the well with an instrument of the perforating gun, the instrumented of the perforating gun comprising at least one of a fiber optic line and intelligent completions device.

28. The method of claim 27, wherein the monitoring comprises detecting whether one or more shaped charges of the perforating gun have fired.

29. The method of claim 27, wherein the monitoring comprises measuring a temperature in the well.

30. The method of claim 27, wherein the monitoring comprises measuring a pressure in the well.

31. The method of claim 27, further comprising instrumenting the perforating gun with a fiber optic line that extends into a shaped charge region of the perforating gun.

32. The method of claim 27, further comprising instrumenting the perforating gun with an intelligent completions device positioned in a shaped charge region of the perforating gun.

33. The method of claim 27, further comprising performing a remedial action based upon monitoring.

34. The method of claim 33, wherein the remedial action comprises perforating the well.

35. The method of claim 27, further comprising the at least one of the fiber optic line and intelligent completions device providing data during a perforation job.

36. A method for completing a well, comprising:

running into the well a completion having an instrumented perforating gun attached thereto;

activating the perforating gun;

monitoring a characteristic in the well with an instrument of the perforating gun; and routing at least one fiber optic line along the completion and the perforating gun.

37. The method of claim 36, further comprising setting the completion adjacent a formation perforated with the perforating gun.

38. The method of claim 36, further comprising injecting a material into the well.

39. The method of claim 38, wherein the material is selected from a gravel slurry, a proppant, a fracturing fluid, a chemical treatment, a cement, and a well fluid.

40. The method of claim 38, further comprising monitoring a characteristic in the well using instrumentation on the completion.

41. A method for completing a well, comprising:

running into the well a completion having an instrumented perforating gun attached thereto;

activating the perforating gun;

monitoring a characteristic in the well with an instrument of the perforating gun, wherein the instrument is a fiber optic line that provides at least one of a distributed temperature measurement, a distributed pressure measurement, a distributed stress measurement, a strain temperature measurement, a distributed sand detection measurement, and a distributed seismic measurement.

42. A method for completing a well, comprising:

running into the well a completion having an instrumented perforating gun attached thereto;

activating the perforating gun;

monitoring a characteristic in the well with an instrument of the perforating gun; and gravel packing the well.

43. The method of claim 42, further comprising monitoring a characteristic in the well using instrumentation on the completion.

44. A device for use in a well, comprising:

a pair of perforating guns;

an intergun housing positioned between the perforating guns; and an instrument provided in the intergun housing, wherein the instrument comprises at least one of a fiber optic line and an intelligent completions device.

* * * * *